US011253080B2

(12) United States Patent
Chen

(10) Patent No.: US 11,253,080 B2
(45) Date of Patent: Feb. 22, 2022

(54) VOICE-CONTROL INTELLIGENT MATTRESS WITH HARDNESS CAPABLE OF BEING ADJUSTED IN MULTIPLE STAGES

(71) Applicant: Ruixi Chen, Fujian (CN)

(72) Inventor: Ruixi Chen, Fujian (CN)

( * ) Notice: Subject to any disclaimer, the term of this patent is extended or adjusted under 35 U.S.C. 154(b) by 51 days.

(21) Appl. No.: 16/658,178

(22) Filed: Oct. 21, 2019

(65) Prior Publication Data

US 2021/0112991 A1 Apr. 22, 2021

(51) Int. Cl.

| | |
|---|---|
| ***A47C 23/22*** | (2006.01) |
| ***A47C 23/28*** | (2006.01) |
| ***A47C 31/00*** | (2006.01) |
| ***A47C 27/15*** | (2006.01) |
| ***A47C 23/00*** | (2006.01) |

(52) U.S. Cl.

CPC ..... *A47C 31/008* (2013.01); *A47C 23/002* (2013.01); *A47C 23/22* (2013.01); *A47C 23/28* (2013.01); *A47C 27/15* (2013.01)

(58) Field of Classification Search

CPC ..... A47C 23/002; A47C 23/12; A47C 23/18; A47C 23/20; A47C 23/22; A47C 23/24; A47C 23/26; A47C 23/28; A47C 2/066; A47C 27/148; A47C 27/15; A47C 27/16; A47C 31/008; A47C 23/066

See application file for complete search history.

(56) References Cited

U.S. PATENT DOCUMENTS

| | | | | | |
|---|---|---|---|---|---|
| 2,616,100 | A * | 11/1952 | Weiner | A47C 27/16 | 5/236.1 |
| 3,551,924 | A * | 1/1971 | Frue, Sr. | A47C 27/148 | 5/722 |
| 3,739,409 | A * | 6/1973 | Johnson | A47C 27/144 | 5/697 |
| 4,190,914 | A * | 3/1980 | Diallo | A47C 23/0438 | 5/247 |
| 4,222,137 | A * | 9/1980 | Usami | A47C 23/0435 | 5/697 |
| 5,063,625 | A * | 11/1991 | Perry | A47C 23/0435 | 5/697 |
| 5,513,402 | A * | 5/1996 | Schwartz | A47C 27/16 | 5/691 |

(Continued)

FOREIGN PATENT DOCUMENTS

| | | | | |
|---|---|---|---|---|
| AT | 513357 A1 * | 3/2014 | ..... | A47C 23/24 |
| DE | 4433341 A1 * | 3/1996 | ..... | A47C 21/046 |

*Primary Examiner* — Michael Safavi

(57) ABSTRACT

A voice-control intelligent mattress with hardness capable of being adjusted in multiple stages comprises an upper-layer soft pad, a hardness-adjusting device and a lower layer or a multi-layered hard pad that are sequentially arranged from top to bottom; the hardness-adjusting device comprises two adjusting units symmetrically arranged with the transverse center line of the present invention, and a voice-control module connected with the adjusting unit through a wire for controlling the starting and stopping of the adjusting unit; two adjusting frames connected with the adjusting unit are symmetrically arranged on the two sides of the adjusting unit; an elastic mesh belt installed on the adjusting frames is tightened or loosened along the expansion or contraction of the adjusting frames; the hardness of the mattress can be precisely adjusted so that the various demands of users can be satisfied.

7 Claims, 3 Drawing Sheets

(56) References Cited

U.S. PATENT DOCUMENTS

| | | | | |
|---|---|---|---|---|
| 2015/0351982 | A1* | 12/2015 | Krenik | A61G 7/018 5/616 |
| 2018/0255941 | A1* | 9/2018 | Longman | A47C 27/083 |
| 2019/0274447 | A1* | 9/2019 | Ishay | A47C 23/14 |
| 2020/0029706 | A1* | 1/2020 | Yao | A47C 31/123 |
| 2020/0253383 | A1* | 8/2020 | Young | G05B 15/02 |

* cited by examiner

VOICE-CONTROL INTELLIGENT MATTRESS WITH HARDNESS CAPABLE OF BEING ADJUSTED IN MULTIPLE STAGES

TECHNICAL FIELD OF THE INVENTION

The present invention relates to the technical field of daily necessities, and more particularly, to a voice-control intelligent mattress with hardness capable of being adjusted in multiple stages.

BACKGROUND OF THE INVENTION

People are always looking for better sleep quality. Sleep occupies one-third of one's life time, and the quality of sleep directly affects one's routine work and efficiency. A mattress is one of the daily necessities. People thus demand more on the appearance, hardness, comfort, function and quality of the mattress. As a result, the mattress is required to be multifunctional. As everybody knows, the demands of consumers are diversified and individualized, and especially the demands of hotel consumers. Luxury hotel consumers have particularly high demands.

In the prior art, mattresses can be divided into a spring mattress, a palm mattress, a latex mattress, a water mattress and an air mattress, etc., wherein the spring mattress is most commonly used. Although various mattresses are sold on the market, their hardness is not adjustable, wherein one side of the mattress is soft and the other side is hard. If a consumer feels uncomfortable after buying a traditional mattress home, the hardness of the mattress cannot be precisely adjusted.

SUMMARY OF THE INVENTION

The purpose of the present invention is to solve the shortcomings in the prior art by providing voice-control intelligent mattress with hardness capable of being adjusted in multiple stages according to various demands of users.

To achieve the above purpose, the present invention adopts the following technical solution:

A voice-control intelligent mattress with hardness capable of being adjusted in multiple stages comprises an upper-layer soft pad, a hardness-adjusting device and a lower layer or a multi-layered hard pad that are sequentially arranged from top to bottom; the hardness-adjusting device comprises two adjusting units symmetrically arranged with the transverse center line of the present invention, and a voice-control module connected with the adjusting unit through a wire for controlling the starting and stopping of the adjusting unit; two adjusting frames connected with the adjusting unit are symmetrically arranged on the two sides of the adjusting unit; an elastic mesh belt installed on the adjusting frames is tightened or loosened along the expansion or contraction of the adjusting frames.

In another aspect of the present invention, the adjusting unit comprises a driving motor, and a threaded rod coaxial with the output shaft is fixedly arranged on the output shaft of the driving motor, wherein one end of the threaded rod that is far away from the driving motor is in threaded connection with the adjusting frame.

In another aspect of the present invention, the adjusting frame comprises a longitudinal chain bar, and transverse adjusting rods that are perpendicular to and connected with the longitudinal chain bar. A transverse adjusting rod is arranged along the axis direction of the threaded rod and is in threaded connection with the threaded rod. A limiting block is arranged at the position where the chain units of the longitudinal chain rod are hinged, thereby allowing the longitudinal chain bar to bend downwards, and enabling the mattress to be vacuum-compressed, rolled and conveniently transported.

In another aspect of the present invention, the lower layer or the multi-layered hard pad is made of a hard ordinary sponge or a high-resilience sponge, and can be vacuum-compressed and rolled.

In another aspect of the present invention, a plurality of elastic reinforcing strips fixedly connected with the elastic mesh belt is arranged along the width direction of the elastic mesh belt.

In another aspect of the present invention, at least three stages of hardness adjustment are set in the voice-control module.

Compared with the prior art, the present invention has the following advantages:

According to the present invention, the hardness of the mattress can be precisely adjusted so that the various demands of users can be satisfied. Moreover, through adding the voice-control module, the operation mode of the present invention is simplified, facilitating a user's adjustment.

MARKING INSTRUCTIONS OF THE DRAWINGS

1—Upper-layer Soft Pad, 2—Hardness-adjusting Device, 21—Adjusting Unit, 211—Driving Motor, 212—Threaded Rod, 22—Voice-control Module, 23—Adjusting Frame, 231—Longitudinal Chain Bar, 2311—Chain Unit, 2312—Limiting Block, 232—Transverse Adjusting Rod, 24—Elastic Mesh Belt, 25—Elastic Reinforcing Strip, 3—Low-layer Hard Pad.

DETAILED DESCRIPTION OF THE INVENTION

Drawings and detailed embodiments are combined hereinafter to elaborate the technical principles of the present invention. Obviously, the described embodiments are only a part of embodiments of the present invention, not all embodiments of the present invention. All other embodiments obtained without paying creative labor by persons of ordinary skill in the art based on the embodiments of the present invention shall fall within the protection scope of the present invention.

Figure 1:
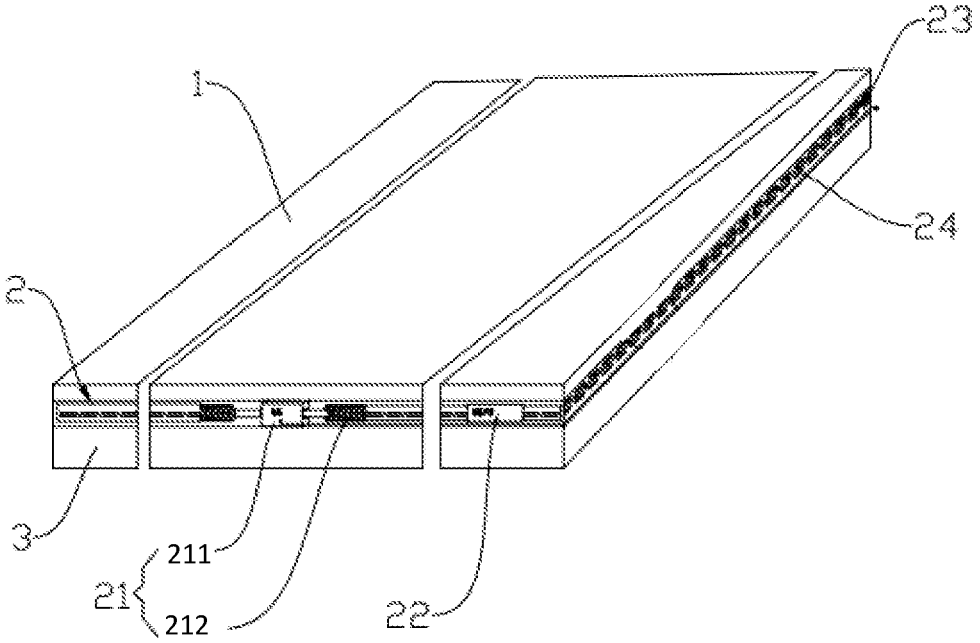
FIG. 1 is a structural diagram of the present invention in a perspective view.
Figure 2:
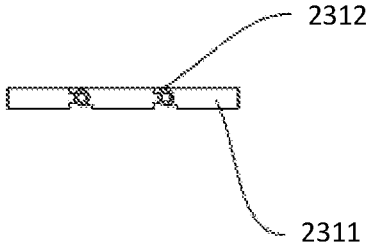
FIG. 2 is a sectional view of the adjusting frame (23).
Figure 3:
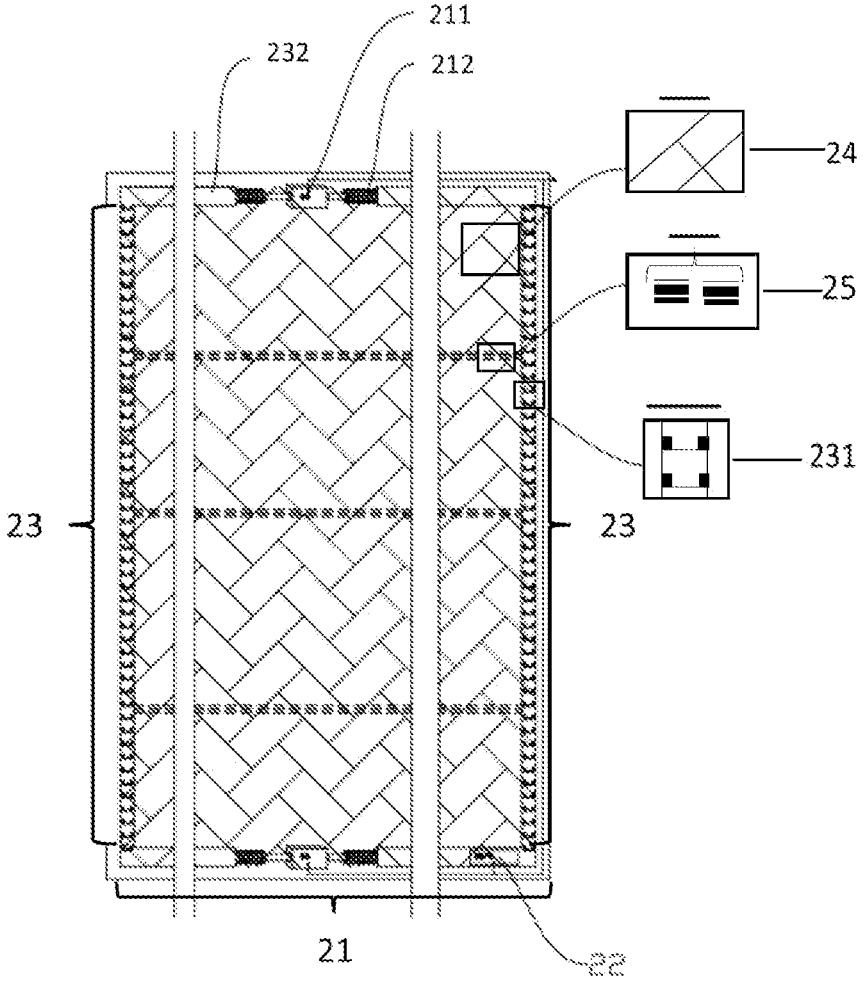
FIG. 3 is a top view of FIG. 1.

As shown in FIGS. 1-2, a voice-control intelligent mattress with hardness capable of being adjusted in multiple stages comprises an upper-layer soft pad 1, a hardness-adjusting device 2 and a lower layer or a multi-layered hard pad 3 that are sequentially arranged from top to bottom, wherein the upper-layer soft pad is made of a material with relatively-high softness, such as latex, ordinary sponge or memory sponge, and the lower layer or the multi-layered hard pad is made of a material with hardness higher than that of the upper-layer soft pad, such as hard sponge, high-resilience sponge, palm plate or sheet frame. Specifically, the hardness-adjusting device 2 comprises two adjusting units 21 symmetrically arranged with the transverse center line of the present invention, and a voice-control module 22 connected with the adjusting unit 21 through a wire for controlling the starting, stopping, forward rotation and reverse rotation of the adjusting unit 21. Meanwhile, two adjusting frames 23 connected with the adjusting unit are symmetrically arranged on the two sides of the adjusting unit, and the adjusting frame can move horizontally under the action of the adjusting unit. An elastic mesh belt 24 that is fixedly connected with the two adjusting frames is arranged on the two adjusting frames. Specifically, the elastic mesh belt is formed by weaving a linear material with elastic contractility for supporting the upper-layer soft pad. During operation, the elastic mesh belt is tightened along the outward expansion of the adjusting frames, and is loosened along the contraction of the adjusting frames. Moreover, in this embodiment, for achieving the recognition of the voice instructions and the instruction transmission to the adjusting units, the voice recognition module can adopt a WTK6900B02 series product manufactured by Shenzhen Waytronic Electronics Co., Ltd.

The synchronous extension or contraction of the two sides of the adjusting unit can be achieved in a plurality of structural forms, such as a cylinder structure or a gear rack structure. In order to reduce the manufacturing cost and improve the transmission precision, a screw rod structure is adopted in this embodiment. Specifically, the adjusting unit 21 comprises a driving motor 211 with double coaxial output shafts, and a threaded rod 212 coaxial with the output shaft is fixedly arranged on the output shaft of the driving motor, wherein one end of the threaded rod that is far away from the driving motor 211 is in threaded connection with the adjusting frame, thereby driving the adjusting frame to move along the axis direction of the threaded rod through propelling the threaded rod to rotate forwardly and reversely.

As a further improvement of the above embodiment, the adjusting frame 23 comprises a longitudinal chain bar 231 that is arranged in parallel along the length direction of the mattress, and transverse adjusting rods 232 that are perpendicular to the longitudinal chain bar are fixedly connected to the two ends of the longitudinal chain bar. One end of the transverse adjusting rod that is far away from the longitudinal chain bar is in threaded connection with the threaded rod 212. The longitudinal chain bar comprises a plurality of chain units 2311 that are hinged end to end, and a limiting block 2312 extending axially is arranged at the head portion of the chain unit. When two chain units are in a 180-degree state, the limiting block abuts against the tail portion of the previous chain unit, thereby preventing the two chain units from rotating relative to each other. In this way, the longitudinal chain bar consisted of a plurality of chain units can be protected from being continuously bent when in a flat state. When a force in the same direction as the limiting block 2312 is imposed on the longitudinal chain bar, the chain units are no longer limited by the limiting block, thus allowing the chain units to achieve a horizontal support and bend downwards in a single direction.

As a further improvement of the above embodiment, in order to conveniently roll the mattress of the present invention and reduce its space occupation, the lower layer or the multi-layered hard pad is made of a hard ordinary sponge or a high-resilience sponge. When the present invention needs to be conveniently rolled and stored, it can be high-vacuum compressed first, and then bent and rolled, thereby greatly reducing the space occupation and the labor intensity during the manual operation.

As a further improvement of the above embodiment, in order to further enhance the strength of the elastic mesh belt, and ensure the elastic mesh belt can be recovered when partially bearing a pressure, a plurality of uniformly arranged elastic reinforcing strips are arranged along the width direction of the elastic mesh belt, and specifically, the elastic reinforcing strips can be reinforcing spring strips.

As a further improvement of the above embodiment, in order to facilitate a user's operation, at least three stages of hardness adjustment are pre-set in the voice-control module 22.

The operating principle of the present invention is the following: when a user feels the hardness of the mattress is not comfortable and want it to be adjusted, a voice instruction can be given to make the mattress softer or harder; at this point, the voice-control module receives the instruction, sends a start instruction to the adjusting unit, and controls the driving motor to make a corresponding rotation; in this way, the threaded rod is driven to rotate, thereby propelling the adjusting frame to move in the axial direction of the threaded rod; meanwhile, the elastic mesh belt installed on the adjusting frames is tightened along the outward expansion of the adjusting frames, and is loosened along the contraction of the adjusting frames; thus, the supporting effect of the elastic mesh belt to the upper-layer soft pad can be adjusted, finally making the user feel that the mattress becomes softer or harder.

The invention claimed is:

1. A voice-control intelligent mattress with hardness capable of being adjusted in multiple stages, comprising:

an upper-layer soft pad, a hardness-adjusting device, and a lower layer or a multi-layered hard pad that are sequentially arranged from top to bottom, wherein the hardness-adjusting device comprises two adjusting units symmetrically arranged with the transverse center line of the mattress, and a voice-control module connected with each of the two adjusting units through a wire for controlling the starting and stopping of each of the two adjusting units, wherein two adjusting frames connected with each of the adjusting units are symmetrically arranged on the two sides of each adjusting unit, wherein an elastic mesh belt installed on the adjusting frames is tightened or loosened along the expansion or contraction of the adjusting frames wherein each of the adjusting units comprises a driving motor, and a threaded rod coaxial with an output shaft is fixedly arranged on the output shaft of the driving motor, wherein one end of the threaded rod that is far away from the driving motor is in threaded connection with their respective adjusting frame.

2. The voice-control intelligent mattress with hardness capable of being adjusted in multiple stages of claim 1, wherein the lower layer or the lower layer of the multi-layered hard pad is made of a hard ordinary sponge or a high-resilience sponge, and can be vacuum-compressed, rolled and conveniently transported.

3. A voice-control intelligent mattress with hardness capable of being adjusted in multiple stages, comprising:

an upper-layer soft pad, a hardness-adjusting device, and a lower layer or a multi-layered hard pad that are sequentially arranged from top to bottom, wherein the hardness-adjusting device comprises two adjusting units symmetrically arranged with the transverse center line of the mattress, and a voice-control module connected with each of the two adjusting units through a wire for controlling the starting and stopping of each of the two adjusting units, wherein two adjusting frames connected with each of the adjusting units are symmetrically arranged on the two sides of each adjusting unit, wherein an elastic mesh belt installed on the adjusting frames is tightened or loosened along the expansion or contraction of the adjusting frames wherein the adjusting frame comprises a longitudinal chain bar, and transverse adjusting rods that are perpendicular to and connected with the longitudinal chain bar, wherein a transverse adjusting rod is arranged along the axis direction of the threaded rod and is in threaded connection with the threaded rod, wherein a limiting block is arranged at the position where chain units of the longitudinal chain rod are hinged, thereby allowing the longitudinal chain bar to bend downwards and be rolled.

4. The voice-control intelligent mattress with hardness capable of being adjusted in multiple stages of claim 3, wherein the lower layer or the lower layer of the multi-layered hard pad is made of a hard ordinary sponge or a high-resilience sponge, and can be vacuum-compressed, rolled and conveniently transported.

5. A voice-control intelligent mattress with hardness capable of being adjusted in multiple stages, comprising:

an upper-layer soft pad, a hardness-adjusting device, and a lower layer or a multi-layered hard pad that are sequentially arranged from top to bottom, wherein the hardness-adjusting device comprises two adjusting units symmetrically arranged with the transverse center line of the mattress, and a voice-control module connected with each of the two adjusting units through a wire for controlling the starting and stopping of each of the two adjusting units, wherein two adjusting frames connected with each of the adjusting units are symmetrically arranged on the two sides of each adjusting unit, wherein an elastic mesh belt installed on the adjusting frames is tightened or loosened along the expansion or contraction of the adjusting frames wherein the lower layer or the lower layer of the multi-layered hard pad is made of a hard ordinary sponge or a high-resilience sponge, and can be vacuum-compressed, rolled and conveniently transported.

6. The voice-control intelligent mattress with hardness capable of being adjusted in multiple stages of claim 5, wherein a plurality of elastic reinforcing strips fixedly connected with the elastic mesh belt is arranged along the width direction of the elastic mesh belt.

7. The voice-control intelligent mattress with hardness capable of being adjusted in multiple stages of claim 5, wherein at least three stages of hardness adjustment are set in the voice-control module.

* * * * *